US006925269B2

(12) United States Patent
Hibino

(10) Patent No.: US 6,925,269 B2
(45) Date of Patent: Aug. 2, 2005

(54) DEVELOPING APPARATUS

(75) Inventor: Masaru Hibino, Ushiku (JP)

(73) Assignee: Canon Kabushiki Kaisha, Tokyo (JP)

( * ) Notice: Subject to any disclaimer, the term of this patent is extended or adjusted under 35 U.S.C. 154(b) by 67 days.

(21) Appl. No.: 10/263,808

(22) Filed: Oct. 4, 2002

(65) Prior Publication Data

US 2004/0067071 A1 Apr. 8, 2004

(30) Foreign Application Priority Data

Oct. 4, 2001 (JP) ..... 2001-308402

(51) Int. Cl.[7] ..... G03G 15/06
(52) U.S. Cl. ..... 399/55; 399/56; 399/265
(58) Field of Search ..... 399/53, 55, 56, 399/222, 265, 267, 252, 258, 259, 270, 275, 276, 277, 286

(56) References Cited

U.S. PATENT DOCUMENTS 5,860,050 A * 1/1999 Shimamura et al. ..... 399/276
6,219,514 B1 4/2001 Kobayashi et al. ..... 399/277
6,295,432 B1 9/2001 Inoue et al. ..... 399/270

FOREIGN PATENT DOCUMENTS

| | | |
|---|---|---|
| JP | 1-277256 | 11/1989 |
| JP | 3-36570 | 2/1991 |
| JP | 11-174793 | 7/1999 |
| JP | 2000-321852 | 11/2000 |

* cited by examiner

*Primary Examiner*—Hoang Ngo
(74) *Attorney, Agent, or Firm*—Fitzpatrick, Cella, Harper & Scinto

(57) ABSTRACT

A developing apparatus includes a developer container for containing a developer containing toner and carrier particles having a volume resistivity of $10^6$–$10^{10}$ Ωcm; a developer carrying member for carrying the developer contained in the developer container; a voltage applying means for applying a developing bias voltage having a DC component and an AC component to the developer carrying member when an electrostatic image formed on an image hearing member including a surface layer having a volume resistivity of $10^9$–$10^{14}$ Ωcm is developed by contacting the developer carried on the developer carrying member to the electrostatic image, wherein a volume resistivity of the developer carrying member is $1\times10^{-1}$–$1\times10^{2}$ Ωcm.

6 Claims, 4 Drawing Sheets

DEVELOPING APPARATUS

FIELD OF THE INVENTION AND RELATED ART

The present invention relates to a developing apparatus for developing an electrostatic latent image formed on an image bearing member. In particular, it relates to a developing apparatus employed by a copying machine, a printer, facsimileing machine, etc.

There has been known an image forming method in which an image bearing member is charged; an electrostatic latent image is formed by exposing the charged image bearing member; and the latent image is developed into a visible image with the use of two-component developer. Here, this image forming method will be briefly described with reference to the image forming apparatus (copying machine) in FIG. 4. An original G is placed on an original placement platen 10 of the copying machine in FIG. 4, the surface with the image to be copied facing downward. As a copy start button is pressed, an operation for copying the original G, that is, an image forming operation, is started. The copying machine comprises: a lamp for illuminating the original G; a lens array with a short focal point; and an optical scanning unit 9 integral with a CCD sensor. As the copy start button is pressed, this unit 9 begins to scan the original G while illuminating the original G with the lamp. As the original G is scanned, the light from the lamp is reflected by the surface of the original, and enters the lens array, by which it is focused on the CCD sensor.

The CCD sensor comprises a receptor portion, a transfer portion, and an output portion. As the reflected light, that is, optical signals, enters the receptor portion, it is converted into electrical signals in the form of electrical charges. These electrical charges are sequentially transferred to the output portion in synchronism with clock pulses. In the output portion, the electrical charges are converted into electrical signals in the form of voltage, are amplified, and are reduced in impedance. They, the electrical signals in the form of voltage are outputted from the output portion. The thus obtained image signals (analog signals) are converted into digital signals through the known process. Then, the digitized image signals are sent to the printer portion of the copying machine.

In the printer portion, first, an electrostatic latent image is formed on the peripheral surface of a photoconductive drum 1. More specifically, while the photoconductive drum 1 is rotationally driven about its rotational axis at a predetermined peripheral velocity, its peripheral surface is uniformly charged to, for example, −600 V, by a corona-type charging device 3. The uniformly charged peripheral surface of the photoconductive drum 1 is scanned by a beam L of laser light emitted, while being directed toward the peripheral surface of the photoconductive drum 1, from the solid laser element of a scanning portion 100, which is turned on and off in accordance with the above described image signals (digital signals). As a result, an electrostatic latent image corresponding to the image of the original is gradually formed, on the peripheral surface of the photoconductive drum 1. As this electrostatic latent image is developed by a developing device 4, a toner image appears, as a visual image, on the peripheral surface of the photoconductive drum 1.

Next, this developing process will be described Developing methods can be roughly divided into four groups. A first one is the nonmagnetic noncontact developing method group which uses nonmagnetic single-component developer. According to this group, single-component developer, which is nonmagnetic toner, is coated on the peripheral surface of a development sleeve (developer bearing member) with the use of a blade or the like, and is conveyed by the development sleeve to the photoconductive drum 1 to develop the latent image on the photoconductive drum 1, with no contact between the development sleeve side and photoconductive drum 1 side. A second one is the magnetic contact developing method group which uses magnetic single-component developer. According to this group, the developer is coated on the peripheral surface of the development sleeve using the magnetic properties of the single-component developers that is, magnetic toner, and is conveyed by the development sleeve to the photoconductive drum 1 to develop the latent image on the photoconductive drum 1, as in the first developing method. In the case of the second group, however, contact is made between the development sleeve side and photoconductive drum 1 side. Third and fourth groups are two-component contact developing method group (two-component magnetic brush developing method) and two-component noncontact developing method group, respectively. Both groups use two-component developer, which is a mixture of nonmagnetic toner and magnetic carrier, and the two-component developer is coated on the peripheral surface of the development sleeve using the magnetic properties of the magnetic carrier, and is conveyed by the development sleeve to the photoconductive drum 1 to develop the latent image on the peripheral surface of the photoconductive drum 1. However, the third and fourth grounds are different in that in the third group, the development process is carried out with contact between the development sleeve side and photoconductive drum side, whereas in the fourth group, there is no contact between the two sides. Among the above described four groups of developing methods, the two component magnetic brush developing method group is most widely employed because of its high image quality and reliability The developing device 4 is structured as a developing device which uses two-component magnetic brush. It is provided with a developer container 16 for holding two-component developer. The developer container 16 is provided with an opening, which faces the photoconductive drum 1, and a development sleeve 11, on which the developer is borne, is disposed so that it opposes the photoconductive drum 1 through the opening of the developer container 16, forming the developing station. The development sleeve 11 and photoconductive drum 1 are disposed so that the shortest distance between the two becomes approximately 500 $\mu$m, which is a proper distance for the developer on the peripheral surface of the photoconductive drum 1 to make contact with the peripheral surface of the photoconductive drum 1 in order to satisfactorily develop the latent image on the peripheral surface of the photoconductive drum 1. Within the development sleeve 11, a magnetic roll is statically disposed, although it is not shown in the drawing. Further, a regulating blade, unshown, is disposed in the adjacencies of the development sleeve 11, with its free edge being in contact with the development sleeve 111.

As the toner for the developer used by, for example, the above described two-component developing method, a mixture of negatively chargeable toner, which is manufactured by pulverization and is approximately 7 $\mu$m in average particle diameter, and an external additive such as titanium oxide particles, or the like, which is approximately 20 nm in average particle diameter is used. The ratio of the external additive to the toner is approximately 1 wt. %. As the carrier for the developer, for example, magnetic ferrite carrier, which is 230 emu/cm$^3$ and is 40 $\mu$m in average particle diameter, is used. The developer is the mixture of the above described toner and carrier, the weight ratio of which is 7:93.

In the developing device 4, as the development sleeve 11 rotates, the developer in the developer container 16 is pick up by the magnetic force of the magnetic roll, onto the peripheral surface of the development sleeve 11, forming a developer layer, and is conveyed toward the development station in which the development sleeve 11 opposes the photoconductive drum 1. While being conveyed toward the development station, the developer layer on the development sleeve 11 is regulated in thickness by a regulating blade, turning into a thin development layer uniform in thickness. As this thin developer layer reaches the point in the development station, corresponding in position to the primary pole of the magnetic roll, the developer particles in the developer layer are agglomerated in the form of a brush extending toward the photoconductive drum 1, by the magnetic force of the primary pole (development pole); a magnetic brush is formed. As this magnetic brush comes into contact with the peripheral surface of the photoconductive drum 1, the electrostatic latent image on the photoconductive drum 1 is developed into a toner image, or a visible image.

The development process carried out in this developing device is of a reversal development type. To the development sleeve 11, a development bias, which is a combination of DC voltage and AC voltage, for example, the combination of a DC voltage of −500 V and an AC voltage which is 2,000 V in peak-to-peak voltage Vpp and 2,000 Hz in frequency f, is applied from an unshown development bias power source. Generally, the application of AC voltage adds to development efficiency, improving therefore image quality. However, it is problematical in that it is likely to cause fog.

Thus, in order to prevent the fog generation, a proper amount of difference in potential level is provided between the potential level of the DC voltage applied to the development sleeve 11 and the potential level of an unexposed point of the peripheral surface of the photoconductive drum 1. In the case of a typical apparatus in accordance with the prior art, the difference between the potential level (−650 V) to which the peripheral surface of the photoconductive drum 1 is uniformly charged, and the potential level (−500 V) of the DC voltage applied to the development sleeve 11 constitutes the fog prevention voltage (150 V), whereas the difference (300 V) between the potential level (−200 V) to which the potential level of the uniformly charge peripheral surface of the photoconductive drum 1 attenuates as it is exposed and the potential level (−500 V) of the DC voltage applied to the development sleeve 11, constitutes contrast voltage for transferring toner from the development sleeve 11 onto the photoconductive drum 1.

After being formed through the above described process, the toner image on the photoconductive drum 1 is electrostatically transferred by a transfer charging device 8 onto a transfer medium P delivered to the photoconductive drum 1. After the transfer of the toner image, the transfer medium P is electrostatically separated by a separation charging device 7, and then, is conveyed to a fixing device 6. In the fixing device 6, the toner image is fixed to the transfer medium P by the application of heat and pressure. Then, the transfer medium P is outputted as a print (copy) from the image forming apparatus. After the tone image transfer, the peripheral surface of the photoconductive drum 1 is cleaned by a cleaner 5; the contaminants, such as the toner particles, etc., remaining on the peripheral surface of the photoconductive drum 1 after the toner image transfer, are removed by the cleaner 5. Then, the cleaned peripheral surface of photoconductive drum 1 is electrically initialized by a pre-exposure lamp 2 to be used in the following image formation cycle.

In the recent years, full-colorization, systematization, and digitization have been in progress in the field of an image forming apparatus. With these progresses, the demand for the improvement in image quality and reliability as well as increase in printing speed has been increasing. Further, it has been predicted that copying machines, printers, etc., such as those described above, will be employed in the field of a small scale printing business. In order for ordinary electrophotographic copying machines, printers, etc., to be employable as the equipment for breaking into the field of a printing business, they must be excellent in at least image quality and reliability. As for the photoconductive member in accordance with the prior art used in the electrophotographic process, photoconductive members that employ selenium, amorphous silicon, organic conductor, or the like, have been put to practical use. In particular, a photoconductive member based on amorphous silicon is well-known for its superior properties; it is superior in image quality and durability.

However, in the case of a photoconductive drum based on amorphous silicon, the volume resistivity of its photoconductive layer falls in the approximate range of $10^9$–$10^{14}$ ohm.cm. Therefore, when it was employed as a photoconductive drum for an electrophotographic image forming apparatus, only such images that suffered from fog and were low in image density were obtained. Further, it was discovered that the fog and the reduction in image density occurred when a latent image formed on a photoconductive, the volume resistivity of the surface layer of which was in the range of $10^9$–$10^{14}$ ohm.cm, was developed using two-component developer, in an alternating electrical field.

From the various studies made regarding the above described phenomena, that is, the fog generation and image density reduction, it became evident that these phenomena occurred because electrical charges were injected from magnetic carrier into the photoconductive drum, the volume resistivity of the surface layer of which was in the range of $10^9$–$10^{14}$ ohm.cm, during the development process.

The photoconductive drum, the volume resistivity of the surface layer of which is in the range of $10^9$–$10^{14}$ ohm.cm, can be satisfactorily charged under the following conditions: magnetic particles, for example, ferrite particles or the like, which is no more than $10^{14}$ ohm.cm in volume resistivity and no more than 100 $\mu$m in particle diameter, preferably, in the range of 15–50 $\mu$m, in average particle diameter, is borne on the peripheral surface of a charge sleeve containing a magnet, and development bias is applied to the charge sleeve while the peripheral surface of the photoconductive drum 1 is rubbed by the magnetic particles on the charge sleeve. This type of charging method is called an injection type charging method. It was discovered that a phenomenon similar to this injection of electrical charge into the photoconductive drum occurred when magnetic carrier, the volume resistivity of which was in the range of approximately $10^6$–$10^{10}$ ohm.cm, was used for development, in particular, when the magnetic carrier was placed in contact with the peripheral surface of the photoconductive drum 1 in the two-component development process.

Further, it has been confirmed that in charge injection, charging efficiency can be improved by the application of an alternating electric field, the frequency of which is in the range of 100–6,000 Hz, preferably, 50–2,000 Hz, in addition to a static electric field. Thus, it is conceivable that even in the case of the above described two-component developing method in accordance with the prior art, the phenomenon similar to this phenomenon occurred because, in order to improve development efficiency and image quality, two-component developer containing magnetic carrier was used, and also, the alternating electric field having a frequency of 2,000 Hz was applied as development bias.

In other words, when an attempt is made to develop in reverse a latent image on a photoconductive drum, the volume resistivity of the peripheral surface of which has been adjusted to a value in the range of approximately $10^9$–$10^{14}$ ohm.cm, using two-component developer containing magnetic carrier, the volume resistivity of which is in the range of approximately $10^6$–$10^{14}$ ohm.cm, by applying an alternating electric field, the frequency of which is in the approximate range of 100–600 Hz, electrical charge is injected into the photoconductive drum from the magnetic carrier for development, in the development station. Therefore, the potential level of white areas (areas of peripheral surface of photoconductive drum which were not exposed after uniform charging of photoconductive drum) and those of the black areas (areas of photoconductive drum which were exposed after uniform charging of photoconductive drum) are both reduced in a manner to converge to the potential level of the DC component of the compound voltage applied to the development sleeve. As a result, the difference in potential level between the white area and development sleeve is reduced, failing to prevent the fog generation. In addition, the difference in potential level between the black area and the development sleeve is also reduced, resulting in the production of images with a low image density.

In the above description of an electrophotographic image forming apparatus in accordance with the prior art, its developing method was described as a reversal developing method. However, it was discovered, through the studies made by the inventors of the present invention, that the above described problems were not peculiar to a reversal developing method; problems similar to the above described problems also occurred when a normal developing method was employed.

SUMMARY OF THE INVENTION

The primary object of the present invention is to provide a developing apparatus which is excellent in image density and image quality.

Another object of the present invention is to provide a developing apparatus in which electrical charge is not injected into the image bearing member from the carrier of the developer, and which therefore does not form images suffering from fog, low image density, and accentuated edges These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Figure 1:
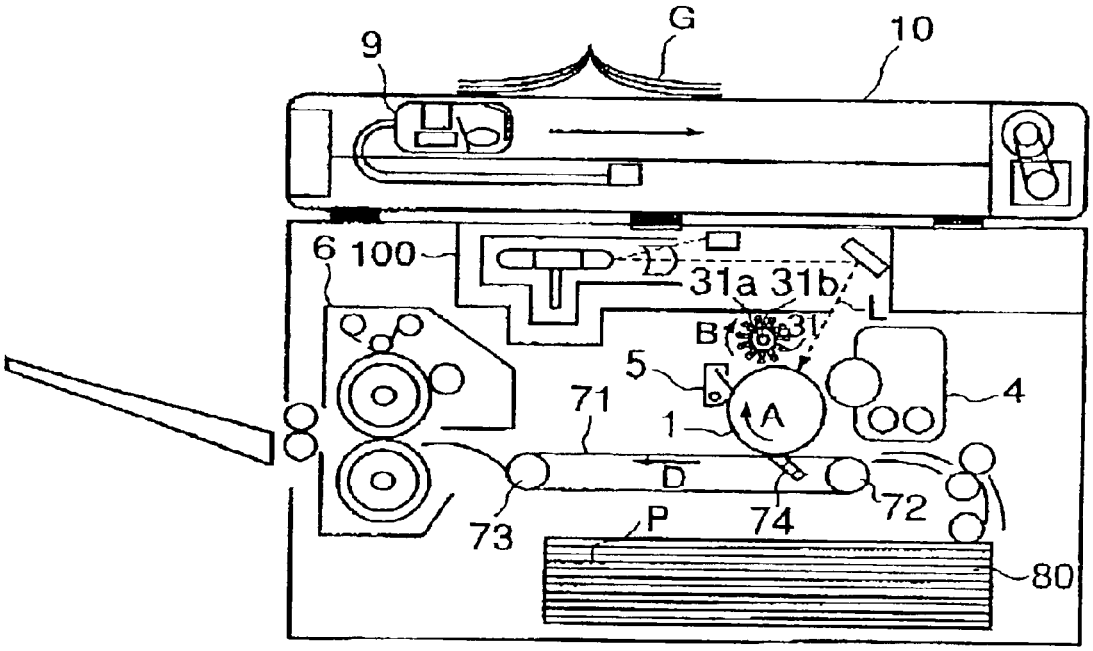
FIG. 1 is a schematic sectional view of a typical image forming apparatus by which the image forming method in accordance with the present invention can be satisfactorily carried out.

Hereinafter, the preferable embodiments of the present invention will be described in more detail with reference to the appended drawings. FIG. 1 is a schematic view of a typical image forming apparatus capable of satisfactorily carrying out the image forming method in accordance with the present invention. The image forming apparatus (copying machine) comprises: an exposure station having an original placement platen 10 and an optical scanning unit 9; and a printer station, which has a photoconductive drum 1, a developing device 4, a laser based scanning portion 100, etc., and which is disposed below the exposure station. An original G is placed on the original placement platen 10 so that the surface bearing the image to be copied faces downward. As a copy start button is pressed, the original G begins to be copied; image formation begins.

The optical scanning unit 9 is an integral assembly of a lamp for illuminating an original, a lens array with a short focal point, a CCD sensor, etc. As a copy start button is pressed, the unit 9 scans the original G while illuminating the original with its lamp, and the light reflected by the surface of the original G is focused by the lens array with the short focal point, on the CCD sensor; an optical image of the original G is formed on the CCD sensor.

The CCD sensor comprises a receptor portion, a transfer portion, and an output portion. The optical signals are converted by the receptor portion into electrical signals in the form of electrical charges. These electrical charges are sequentially transferred to the output portion in synchronism with clock pulses. In the output portion, the electrical charges are converted into electrical signals in the form of voltage, amplified, and reduced in impedance. Then, they are outputted from the output portion. The thus obtained image signals (analog signals) are converted into digital signals through the known process. Then, the digitized image signals are sent to the printer station of the copying machine.

In the printer station, first, an electrostatic latent image is formed on the peripheral surface of a photoconductive drum 1. More specifically, while the photoconductive drum 1 is rotationally driven about its rotational axis at a predetermined peripheral velocity, its peripheral surface is uniformly charged to, for example, −650 V, by a corona-type charging device 31. The uniformly charged peripheral surface of the photoconductive drum 1 is scanned by a beam L of laser light directed toward the peripheral surface of the photoconductive drum 1 after being emitted from the solid laser element of a scanning portion 100, which is turned on and off in accordance with the above described image signals (digital signals). As a result, an electrostatic latent image corresponding to the image of the original is gradually formed, on the peripheral surface of the photoconductive drum 1.

Figure 2:
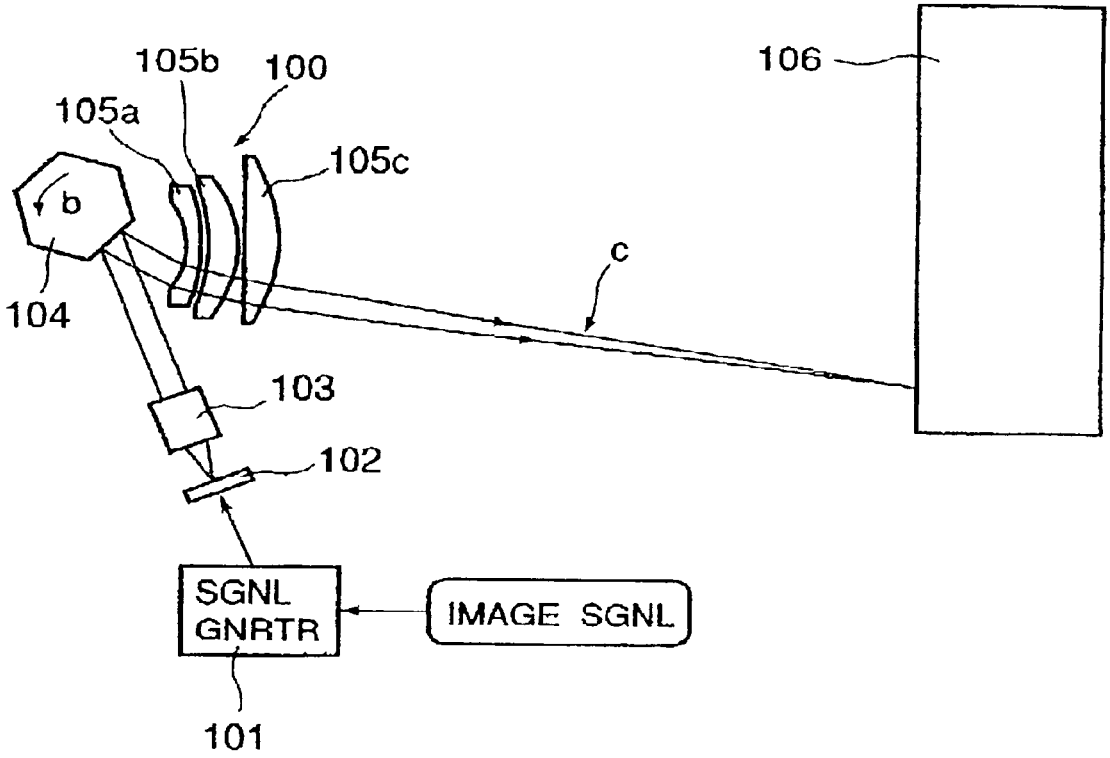
FIG. 2 is a schematic drawing of the laser scanner disposed in the image forming apparatus in FIG. 1.

FIG. 2 shows the general structure of the laser based scanning portion 100 comprising a solid laser element. In the laser based scanning portion 100, first, the solid laser element 102 is turned on and off with a predetermined timing, by a light emission signal generator 101 in response to the inputted image signals. The laser light emitted from the solid laser element through the above described process is converted by a collimator lens system into a beam of parallel light, and then, is projected toward a polygonal mirror 104 which is rotating in the direction indicated by an arrow mark b. As the beam of parallel light is reflected by the rotating polygon mirror 104, it is moved in a scanning fashion in the direction indicated by an arrow mark c, while being kept focused as a light spot on the peripheral surface 106 (surface to be scanned) of the photoconductive drum 1, by an fθ lens group comprising lenses 105*a*, 105*b*, and 105*c*; the peripheral surface 106 is scanned by the beam of laser light emitted from the laser based canning portion. Each time the beam of laser light moves (scans) from one lateral edge of the peripheral surface of the photoconductive drum 1 to the other, a line comprising exposed spots and unexposed spots is formed corresponding to the scanning movement of the beam of laser light. Since the photoconductive drum 1 is being rotationally driven at the predetermined peripheral velocity (peripheral surface is scrolled a predetermined distance per unit of time) in the direction perpendicular to the direction in which the beam of laser light is moved, numerous lines similar to the above described line are formed as the peripheral surface of the photoconductive drum 1 is continuously scanned. As a result, numerous exposed and unexposed spots are created in the pattern reflecting the image signals, on the peripheral surface of the photoconductive drum 1. In other words, an electrostatic latent image is formed on the peripheral surface of the photoconductive drum 1.

In this embodiment of the present invention, a photoconductive member based on amorphous silicon was employed as the photoconductive drum 1. However, a photoconductive member based on ordinary organic photoconductor or the like may be employed. To these photoconductive members, electrical charge can be directly injected; they can be charged using an injection type charging method, which is effective for the prevention of ozone generation as well as reduction in power consumption. The photoconductive drum 1 in this embodiment is a photoconductive drum based on amorphous silicon, being negatively chargeable by nature. It comprises an aluminum drum, as a base member, with a diameter of 80 mm, and a layer of amorphous silicon, as a photoconductive layer, placed on the peripheral surface of the aluminum drum.

In this embodiment, a contact charger of a charge injection type, in particular, a charge injection type based on a magnetic brush, is employed as the charging device 31. The magnetic brush type charging device 31 comprises a rotational nonmagnetic sleeve 31*a* with an external diameter of 16 mm, a magnet 31*b* non-rotationally disposed in the nonmagnetic sleeve 31*a*, and magnetic particles borne on the peripheral surface of the nonmagnetic sleeve 31*a*. The magnetic particles are made to agglomerate in the form of a brush (magnetic brush), by the magnetic field of the magnet 31*b*, so that the tip of the magnetic brush contacts the peripheral surface of the photoconductive drum 1. The magnetic particles agglomerated in the form of a brush are conveyed by the rotation of the nonmagnetic sleeve 31*a*, and as they are conveyed, charge voltage is applied to the nonmagnetic sleeve 31*a*. As a result, electrical charge is given to the photoconductive drum 1 through the magnetic particles, charging the peripheral surface of the photoconductive drum 1 to a potential level proportional to the charge voltage. The employment of a-SiDr (amorphous silicon drum) in combination with a contact charging method mares it possible to prevent the nonuniform attenuation of the charge which occurs across the unexposed areas of the photoconductive drum 1.

The photoconductive drum 1 was satisfactorily charged by the magnetic brush formed of magnetic particles, when the width of the nip, that is, the interface between the magnetic brush and photoconductive drum 1 was adjusted to approximately 6 mm, and the combination of a DC voltage of −700 V and an AC voltage which was 1,000 Hz in frequency, 800 V in peak-to-peak voltage, and rectangular in waveform was used as the charge bias applied to the nonmagnetic sleeve 31*a*.

The rotational direction of the nonmagnetic sleeve 31*a* (hence, rotational direction of magnetic brush) is desired to be the direction B, which is counter to the rotational direction. A of the photoconductive drum 1, as shown in the drawing, so that the photoconductive drum 1 is better charged. There is a tendency that the faster the peripheral velocity of the nonmagnetic sleeve 31*a*, the more uniform the photoconductive drum 1 is charged. In this embodiment, the peripheral velocity of the nonmagnetic sleeve 31*a* was set to 150 mm/sec, whereas the peripheral velocity of the photoconductive drum 1 was set to 100 mm/sec The magnetic particles (magnetic carrier) used for the magnetic brush type charging device 31 are desired to be 10–100 $\mu$m in average particle diameter, 20–250 emu/cm$^3$ in saturation magnetization and $10^2$–$10^{10}$ ohm.cm in electrical resistance. In consideration of the possibility of the presence of the defects, such as pinholes, the preferable range for the electrical resistance of the magnetic particles is approximately $10^6$–$10^{14}$ ohm.cm. In this embodiment, magnetic particles which are 25 $\mu$m in average particle diameter, 200 emu/cm$^3$ in saturation magnetization, and $5\times10^6$ ohm.cm in electrical resistance were used (method used for measuring electrical resistance of magnetic particles is similar to that for magnetic carrier of developer, and will be described later).

As for the selections of magnetic particles usable with the magnetic brush type charging device 31, there are: resinous carrier produced by dispersing magnetite as magnetic material, and carbon black as material for making resinous material electrically conductive or adjusting the electrical resistance of resinous material, in resinous substance; those produced by oxidizing or reducing the surface of the pure ferrite particles, magnetite particles, or the like, in order to adjust their electrical resistance; those produced by coating the surface of the pure magnetite particles with resinous substance in order to adjust their electrical resistance; etc.

After the charging process, an electrostatic latent image is formed on the photoconductive drum 1, and is developed into a toner image, that is, a visible image, by a two-component developing device 4 disposed in the adjacencies of the peripheral surface of the photoconductive drum 1.

Figure 3:
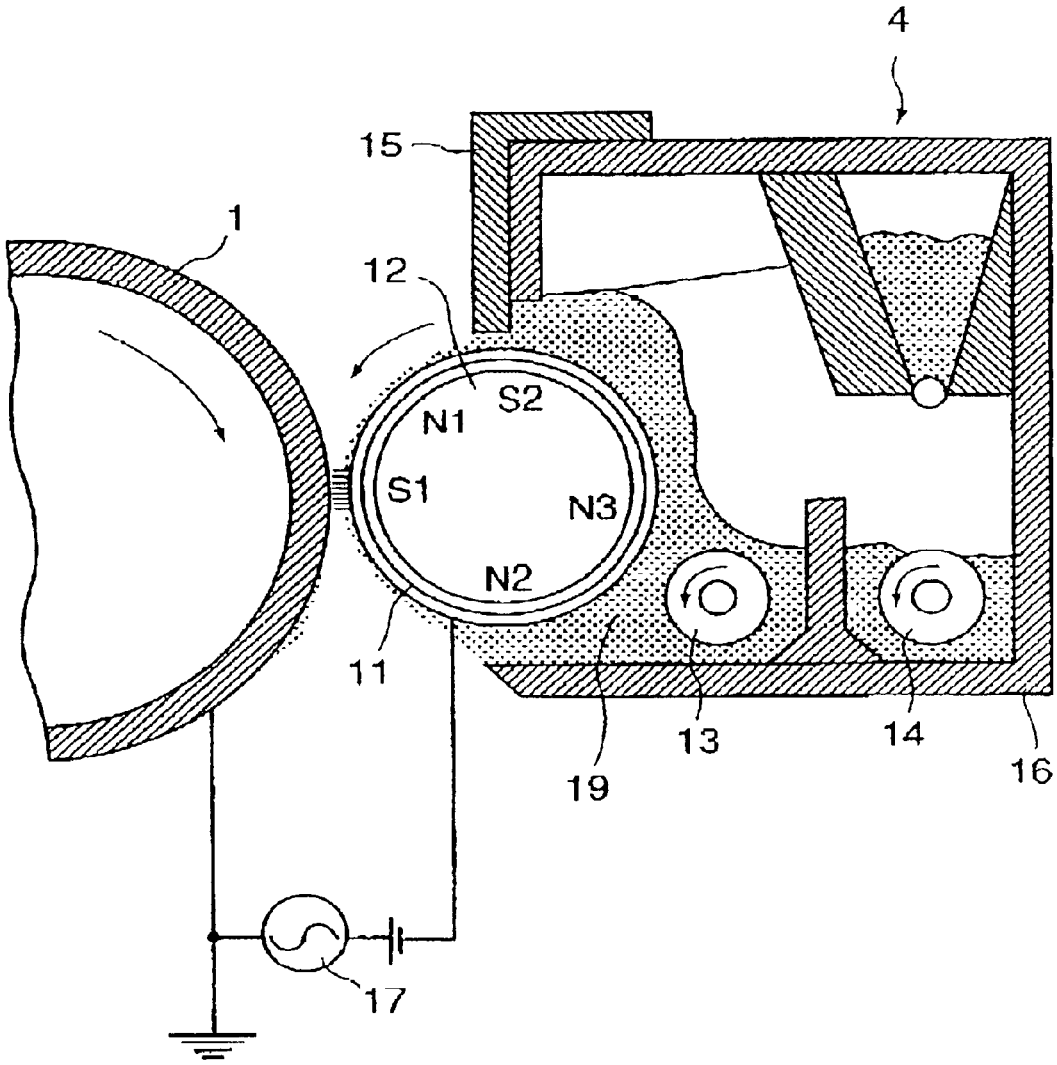
FIG. 3 is a sectional view of the two-component developing device disposed in the image forming apparatus in FIG. 1.
Figure 4:
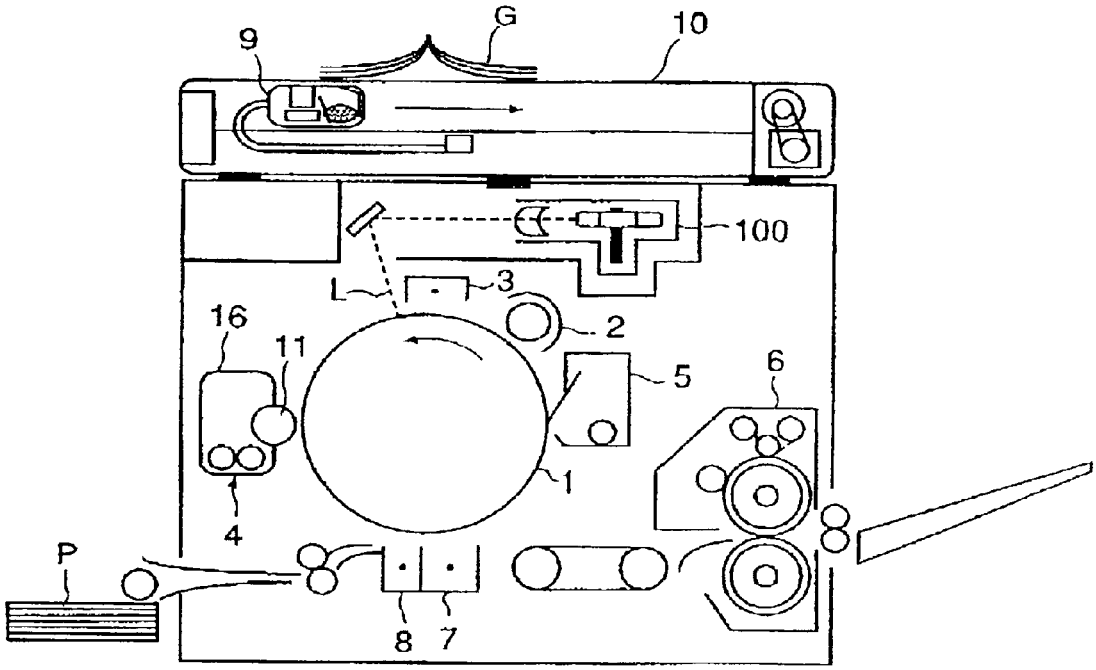
FIG. 4 is a schematic sectional view of the image forming apparatus mentioned to describe the image forming method in accordance with the prior art is described.

FIG. 3 is a schematic drawing of the developing device 4, for showing the general structure thereof. This developing device 4 is structured as a developing apparatus of a two-component magnetic brush type. It has a developer container 16 for holding two-component developer 19 containing toner and magnetic carrier. The developer container 16 has an opening, which faces the photoconductive drum 1. The development sleeve 11 which bears the developer 19 and conveys it to the photoconductive drum 1 is disposed in a manner to oppose the photoconductive drum 1 through the above described opening of the developer container 16. The development sleeve 11 is rotated in such a direction that in the area where the peripheral surfaces of the development sleeve 11 an photoconductive drum 1 oppose each other, the two peripheral surfaces move in the same direction.

The development sleeve 11 and photoconductive drum 1 are 32 mm and 80 mm, respectively, in diameter, and they are disposed so that the shortest distance between the two becomes approximately 500 μm. With this structural arrangement, the developer 19 on the development sleeve 11 comes into contact with the peripheral surface of the photoconductive drum 1 to satisfactorily develop the latent image thereon, as the developer 19 is conveyed to the development station. The amount of the developer 19 coated on the peripheral surface of the development sleeve 11 is 32 $mg/cm^2$. With this amount of the developer 19 on the peripheral surface of the development sleeve 11, the dimension of the contact area, that is, interface, between the magnetic brush formed on the peripheral surface of the development sleeve 11 and the peripheral surface of the photoconductive drum 1 becomes 303 mm in the axial direction of the photoconductive drum 1 (as well as that of development sleeve 11), and 7 mm in the circumferential direction of the photoconductive drum 1.

At this time, the development sleeve will be described. In this embodiment, the development sleeve 11 comprises an electrically conductive base member formed of Al, SUS, or the like, and a surface layer formed of resin or the like, on the peripheral surface of the base member. The surface layer is formed of a material in which electrically conductive microscopic particles and solid lubricant particles, such as carbon black, graphite, etc., have been dispersed. A development sleeve similar in design to the development sleeve 11 in this embodiment is proposed in Japanese Laid-open patent Application 1-277256, and 3-36570. However, the present invention does not limit its application to a development sleeve, the surface layer of which is formed of the above described material.

A development sleeve structured as described above is problematic in that its surface layer formed of the above described materials tends to be charged up, and that as it is charged up, it causes developer to adhere to the development sleeve and solidify thereon. Therefore, the surface layer of such a development sleeve is desired to be more or less electrically conductive. This is why electrically conductive particles were mixed into the resinous material for the surface layer of the development sleeve 11 in this embodiment. In particular, the material for the surface layer of a development sleeve is desired to be formulated so that the volume resistivity of the surface layer of the development sleeve becomes no more than $10^2$ ohm.cm, preferably, its highest value falls in the range $10^1$–$10^2$ ohm.cm, for the following reason. That is, if the volume resistivity of the resinous surface layer of the development sleeve is greater than $10^2$ ohm.cm, the toner particles in the developer are likely to cause blotches, or the like problems. Further, for the purpose of preventing the charge injection which occurs during the development process, and the prevention of which is the object of the present invention, the volume resistivity of the resinous surface layer is desired to be no less than $10^1$ ohm.cm.

In order to adjust the volume resistivity of the electrically conductive resinous surface layer of the development sleeve to a value in the above mentioned range, the surface layer is desired to contain the electrically conductive microscopic particles listed below: particles of metallic substance such as copper, nickel, silver, aluminum, etc., and alloys thereof; particles of metallic oxide, such as antimony oxide, indium oxide, tin oxide, titanium oxide, etc.; particles of electrically conductive substance containing carbon, such as carbon fiber, carbon black, graphite, etc.

The preferable electrically conductive microscopic particles for the present invention are carbon black particles. In particular, electrically conductive amorphous carbon particles are most preferable, since they are superior in electrical conductivity, and therefore, the amount of the amorphous carbon particles required to make the surface layer electrically conductive is much smaller compared to other substances. Further, the volume resistivity of the surface layer can be fairly accurately controlled by controlling the amount of the carbon black mixed into the material for the surface layer. This is why the carbon black is the preferable electrically conductive material for the present invention.

In this embodiment, the volume resistivity of the resinous surface layer of the development sleeve was measured using the following method. A 7–20 μm thick layer of electrically conductive resinous material was formed on a 100 μm thick PET sheet, and its volume resistivity was measured using a digital volume resistivity meter (Kawaguchi Denki Seisakusho Co., Ltd.) in conformity to ASTM standard (D-991-83) as well as Japan Rubber Association standard SRIS (2301-1969). The digital volume resistivity meter was of a voltage drop type, and fitted with four electrodes for measuring volume resistance of electrically conductive rubber and plastic. The environment in which it was measured was 20–25□ and 50–60% in relative humidity.

Within the development sleeve 11, a magnetic roll 12 is statically disposed. In the adjacencies of the development sleeve 11, a regulating blade 15 formed of magnetic substance is vertically disposed, with its bottom end virtually in contact with the highest point of the development sleeve 11. Within the developer container 16, developer stirring/conveying screws 13 and 14 are disposed.

An electrostatic latent image formed on the photoconductive drum 1 is developed by the developing device 4 which employs a two-component magnetic brush based developing method. More concretely, the development sleeve 1 is rotated, and as it is rotated, the developer 19 in the developer container 19 is picked up onto the peripheral surface of the development sleeve 11 by the magnetic pole N3 of the magnetic roll 12. The developer picked up onto the development sleeve 11 is conveyed to the position corresponding to the magnetic pole S2, and then, to the position corresponding to the magnetic pole N1.

While being conveyed from the position corresponding to the magnetic pole S2 to the position corresponding to the magnetic pole N1, the uneven layer of the developer adhering to the peripheral surface of the development sleeve 11 is regulated in thickness, turning into a thin even layer of the developer. As the development sleeve 11 is further rotated, the thin layer of the developer reaches the position corresponding to the magnetic pole S1, or the primary development pole. As the thin layer of the developer reaches the position corresponding to the primary development pole S1, the developer particles in the thin layer of the developer are made to agglomerate in the form of a bush (magnetic brush), by the magnetic force of the primary development pole S1, with the tip of the brush touching the peripheral surface of the photoconductive drum 1 (in FIG. 3, magnetic brush is schematically represented by a plurality of parallel lines extending between development sleeve 11 and photoconductive drum 1, in development station). As a result, the electrostatic latent image on the peripheral surface of the photoconductive drum 1 is developed into a toner image, that is, a visible image.

During the above described development process, a development bias, which is a combination of DC and AC voltages, for example, the combination of a DC voltage of −500 V and an AC voltage which is 2,000 V in peak-to-peak voltage Vpp and 2,000 Hz in frequency f, is applied between the development sleeve 11 and photoconductive drum 1. Generally, in a two-component magnetic brush developing method, the application of AC voltage adds to development efficiency, improving therefore image quality. However, it is problematical in that it is likely to cause fog. Thus, in order to prevent the fog generation, a proper amount of difference in potential level is provided between the potential level of the DC voltage applied to the development sleeve 11 and the potential level of an unexposed area of the peripheral surface of the photoconductive drum 1.

The toner image formed on the photoconductive drum 1 through the development process is transferred onto a transfer medium P conveyed from a sheet feeder cassette 80. Below the photoconductive drum 1, a transfer belt 71 is disposed, which is wrapped around a driver roller 72 and a follower roller 73, being suspended thereby, and is circularly driven in the direction indicated by an arrow mark D in FIG. 1. The transfer medium P is taken out of the sheet feeder cassette 80, and is delivered onto the transfer belt 71 with a proper timing, in synchronism with the rotation of the photoconductive drum 1, and is conveyed by the transfer belt 71 so that it arrives at the transfer station, or the interface between the photoconductive drum 1 and transfer belt 71, with a predetermined timing.

Within the loop of the transfer belt 71, a transfer charge blade 74 is disposed. As electrical power is supplied to this transfer charge blade 74 from an unshown high voltage power source while the transfer belt 71 is kept pressed toward the photoconductive drum 1, the transfer medium P is charged to the polarity opposite to that of the toner from the back side. As a result, the toner image on the photoconductive drum 1 is electrostatically transferred onto the transfer medium P.

In this embodiment, a 75 $\mu$m thick sheet of polyimide resin is used as the material for the transfer belt 71. There are other materials which can be satisfactorily used as the material for the transfer belt 71, for example, sheet formed of polycarbonate resin, polyethylene-terephthalate resin, polyfluorovinylidene resin, polyethylene-naphthalate resin, polyether-ether-ketone resin, polyether-sulfone resin, polyurethane resin, etc., or sheet formed of fluorinated rubber, siliconized rubber, etc. The thickness of the transfer belt 71 does not need to be limited to 75 $\mu$m. It has only to be in the range of approximately 25–250 $\mu$m, preferably, 50–150 $\mu$m.

In this embodiment, a blade which was $10^9$–$10^{14}$ ohm.cm in resistance, 2 mm in thickness, and 306 mm in length was employed as the transfer charge blade 74. The electric current supplied to the transfer charge blade 74 during the transfer was kept constant at +15 $\mu$m.

After the transfer of the toner image, the transfer medium P is separated from the transfer belt 71, and then, is conveyed to a fixing device 6. In the fixing device 6, the toner image is fixed to the transfer medium P by the application of heat and pressure. Then, the transfer medium P is outputted as a print (copy) from the image forming apparatus. After the tone image transfer, the peripheral surface of the photoconductive drum 1 is cleaned by a cleaner 5; the contaminants, such as the toner particles, etc., remaining on the peripheral surface of the photoconductive drum 1 after the toner image transfer, are removed by the cleaner 5. Then, the cleaned peripheral surface of photoconductive drum 1 is used in the following image formation cycle.

This embodiment of the present invention is characterized in that magnetic particles, the volume resistivity of which is in the range of $10^6$–$10^{10}$ ohm.cm, are used as the magnetic carrier for the two-component developer used in the development process in the image forming operation carried out as described above, and that a resinous substance, the volume resistivity of which is no less than $1\times10^{-1}$ ohm.cm and no more than $10^2$ ohm.cm, is used as the material for the surface layer of the development sleeve.

This embodiment of the present invention can be summarized that in order to reliably produce high quality images, an amorphous silicon drum is used as the photoconductive drum 1 whereas in order to obtain high quality images, that is, fog free images, a development sleeve which is high in the electrical resistance of its surface layer is employed as the development sleeve 11. However, the volume resistivity of the magnetic carrier in the developer is not as high as that of the magnetic carrier used by a developing device in accordance with the prior art. With the use of carrier with a high volume resistivity value, the fog generation or density reduction traceable to the charge injection which occurs in the development station can be prevented. However, there will be no electrode which corresponds to the electrical charge of the latent image on the peripheral surface of the photoconductive drum 1. As a result, the "edge accentuation" phenomenon occurs. With the employment of the above described structural arrangement in accordance with the present invention, magnetic carrier with a relatively low electrical resistance will be present in the adjacencies of the latent image formed on the photoconductive drum 1, being enabled to act as the opposing electrode. Thus, high quality images, that is, images which do not suffer from the fog, low image density, and/or "edge accentuation" can be produced for a long period of time As the substances usable as the materials for the magnetic carrier in this embodiment of the present invention, there are ferrite formulated using surface oxidized iron, nonoxidized iron, nickel, cobalt, manganese, chrome, rare-earth metals, etc., or the oxides thereof. The manufacturing method therefor is optional. The magnetic carrier may be coated with resinous substance using any of the known methods.

The magnetic particles used as the magnetic carrier in this embodiment are resin coated ferrite particles which contain neodymium, samarium, barium, etc., the weight average particle diameter of which is in the range of 20–100 $\mu$m, preferably, 20–70 $\mu$m and the volume resistivity of which is in the range of $10^6$–$10^{10}$ ohm.cm, as described above.

The specific resistivity (volume resistivity) of the magnetic carrier was measured using the following method. The magnetic carrier was filled in a cell, and one of a pair of electrodes was disposed in contact with one side of the cell and the other is disposed in contact with the other side of the cell. Then, the amount of electrical current which flowed between the pair of electrodes was measured while applying voltage between the pair of electrodes. As for the conditions under which the specific resistivity was measured, the size of the contact area between the packed carrier and electrode was approximately 2.3 $cm^2$; the thickness of the body of the packed carrier was approximately 2 mm; the amount of the load placed on the top electrode was 180 g; and the applied voltage was 100 V. Since the magnetic carrier is powder, its fill factor is likely to change, which in turn affects the specific resistivity. Thus, in order to prevent this problem, the carrier must be carefully packed. As described above, the resistivity of the magnetic carrier for the charging device was measured using the same method.

If the volume resistivity of the magnetic carrier is no less than $10^{12}$ ohm.cm, the electrode which opposes the electrical charge of the latent image on the photoconductive drum 1 during the development process is weak, and therefore, the edge accentuation is likely to occur. Depending on the development conditions, however, it is possible to take measures for improving the development performance. For example, it is possible to devise the waveform of the development bias; to increase the amount by which the developer is coated on the development sleeve (to increase the amount of the developer supplied to the SDgap; to make the rotational direction of the development sleeve opposite to that of the photoconductive drum; etc. However, any of the above described measures regarding structural arrangement has its own problem. For example, it narrows the latitude in apparatus design, and also, brush marks are left by the magnetic brush, slightly reducing image quality.

When such magnetic particles that are greater than $10^{10}$ ohm.cm in volume resistivity is used as the carrier, the developer becomes virtually electrically nonconductive. The edge accentuation becomes conspicuous. It is difficult to prevent this problem by the devising the development process. When such magnetic particles that are no more than $10^6$ ohm.cm in volume resistivity are used as the carrier, electrical charge is injected into the carrier. Therefore, even if a development sleeve structured as is the development sleeve in this embodiment is employed, problems such as the carrier adhesion, etc., occur. Thus, in order to afford more latitude in apparatus design, as well as to obtain high quality images, that is, images which do not suffer from the edge accentuation, the volume resistivity of the carrier is desired to be no less than $10^6$ ohm.cm and no more than $10^{10}$ ohm.cm. Thus, also in this embodiment, such magnetic particles that are in this range in magnetic resistivity are used as the carrier.

The average particles diameter of magnetic carrier is expressed in the maximum vertical chord length. In this embodiment of the present invention it was obtained using the following method. The carrier particles were photographed at a magnification in the range of 50–1,000×. Then, no less than 3,000 carrier particles were randomly selected in the obtained picture, and their long axes were actually measured. Then, the arithmetic average of the values obtained by the measurement was used as the average particle diameter of the magnetic carrier used in this embodiment.

As the toner used as one of the ingredients of the developer, in combination with the above described magnetic carrier, any the known toners can be used, for example, toner manufactured by pulverization, etc. The preferable range for the volume average particle diameter of the toner is 4–15 μm. The volume average particle diameter of toner can be measured using, for example, the following method.

As the measuring apparatus, Coulter Counter TA-II (Coulter Co., Ltd.) is used. To this apparatus, an interface (Nikkaki Co., Ltd.) which outputs number average distribution and volume average distribution, and a personal computer CX-1 (Canon), are connected. The electrolytic solution is 1% water solution of NaCl formulated using sodium chloride (first class reagent).

To 100–150 ml of the above described electrolyte, 0.1–5 ml of surfactant (preferably, alkylbenzenesulfonate) is added as dispersant. To the thus formulated solution, 0.5–50 mg of toner, the test sample, is added to be suspended therein. This electrolytic solution in which the test sample is suspended is treated approximately 1–3 minutes with the use of an ultrasonic dispersing device. Then, the particle size distribution of the toner particles, the size of which falls in the range of 2–40 μm, is obtained using the aforementioned Coulter counter TA-II fitted with a 100 μm aperture. Then, the volume distribution of the toner is obtained. Then, the volume average particle diameter of the toner is obtained from the thus obtained volume distribution of the toner.

From the standpoint of the durability after being mixed into toner, the particle diameter of the external additive to be used in conjunction with the present invention is desired to be no more than 1/10 the weight average particle diameter of the toner particle. This particle diameter of the external additive means the average particle diameter obtained through surface observation of the external additive particles. The amount of the external additive added to 100 weight parts of toner is desired to be in the range of 0.01–10 weight parts, preferably, 0.05–5 weight parts.

The following are the list of the external additive compatible with the present invention: metallic oxide, such as aluminum oxide, titanium oxide, strontium titanate, cerium oxide, magnesium oxide, chrome oxide, tin oxide, zinc oxide, etc.; nitride, such as silicon nitride, etc.; carbide such as silicon carbide, etc.; metallic salts such as calcium sulfate, barium sulfate, calcium carbonate, etc.; metallic salts of fatty acid, such as zinc stearate, calcium stearate, etc.; carbon black; silica; etc. There external additives may be used alone or in combination. Preferably, they are dehydrated.

In this embodiment, the surface area ratio between the entire toner and entire carrier in the developer is desired to be no less than 2.5. More specifically, when the toner content is n (wt. %), the ratio S of the surface area of the entire toner relative to the surface area of the entire carrier is:

$$S=\{n/(100-n)\}\times(rc/rt)\times(\rho c/\rho t)\square 2.5$$

wherein rt (μm) is the average toner particle diameter; ρt (g/cm$^3$) is the bulk density of the toner; rc (μm) is the average carrier particle diameter; and ρc (g/cm$^3$) is the bulk density of the carrier. Generally, the carrier resistance is greater than the toner resistance. Therefore, the greater the value of S, the greater the developer resistance. Thus, with the development sleeve structure being equal, the greater the value of S, the less the development inject is likely to occur. If a developer which is no more than 2.5 in the value of S is used with a developing apparatus structured in accordance with this embodiment, that is, a developing apparatus structured to use the magnetic carrier, the volume resistivity of which is $10^6$–$10^{10}$ ohm.cm, and the development sleeve, the volume resistivity of the surface layer of which is no less than $1\times10^{-1}$ ohm.cm and no more than $1\times10^2$ ohm.cm, the value of S is desired to be no less than 2.5, because the developer resistance is relatively small. In this embodiment, the value of S was made to be no less than 2.5 using the toner, the bulk density ρt of which was 1.1 g/cm$^3$, and the carrier, the bulk density ρc of which was 5.0 g/cm$^3$.

EMBODIMENTS

Next, the present invention will be more concretely described referring to the preferred embodiment of the present invention.

(Embodiment 1)

Images were formed under the following conditions using the image forming apparatuses described above. Then, the fog and image density of the toner image on the transfer mediums were evaluated. The evaluation criteria were as follows:

fog density<0.5: practically no tog: A (evaluation level)

0.5□ fog density<1: almost no fog: B

1□ fog density<2: slight fog: C

2□ fog density<3: typical fog: D

3□ fog density<conspicuous fog: E

Using Densitometer TC-DS (Tokyo Denshoku Co., Ltd.), a reflection densitometer, the reflection density of the transfer medium was measured prior to the image formation, and the reflection density of the fog portion of the transfer medium was measure after the image formation. Then, the fog density was obtained from the following formula;

$$\text{fog density (\%)} = \text{reflection density (fog portion of transfer medium)} - \text{reflection density (transfer medium)}$$

<Conditions>

| | |
|---|---|
| Surface resistance value of photoconductive drum: | $1.6 \times 10^{10}$ ohm · cm |
| Volume resistance value of magnetic carrier: | $2.0 \times 10^{7}$ ohm · cm |
| Volume resistance value of development sleeve: | $2.2 \times 10^{-1}$ ohm · cm |
| Fog prevention voltage: | 150 V |
| Contrast voltage: | 200 V |
| S value: | 2.6 |

When images were formed under the above conditions, no fog was generated. In other words, the evaluation of the images according to the above described fog evaluation criteria was level A, and the image density of their solid black portions was no less than 1.4. Further, their highlight portions were free of roughness. In other words, satisfactory images were obtained

COMPARATIVE EXAMPLE 1

Images were formed under the following conditions, with other structural conditions left the same as those for the first embodiment, and the fog and image density of the image on the transfer medium were evaluated.

<Conditions>

| | |
|---|---|
| Surface resistance value of photoconductive drum: | $1.6 \times 10^{10}$ ohm · cm |
| Volume resistance value of magnetic carrier: | $2.0 \times 10^{7}$ ohm · cm |
| Volume resistance value of development sleeve: | $2.2 \times 10^{-6}$ ohm · cm |
| Fog prevention voltage: | 150 V |
| Contrast voltage: | 200 V |
| S value: | 2.6 |

When images were formed under the above conditions, a substantial amount of fog was observed; in other words, according to the aforementioned criteria regarding fog, the evaluation was level E. The image density of the solid black portion was 0.8. Further, the highlight portion was rough. Needless to say, dot reproduction was very bad.

COMPARATIVE EXAMPLE 2

Images were formed under the following conditions, with other structural conditions left the same as those for the first embodiment, and the fog and image density of the image on the transfer medium were evaluated.

<Conditions>

| | |
|---|---|
| Surface resistance value of photoconductive drum: | $1.6 \times 10^{10}$ ohm · cm |
| Volume resistance value of magnetic carrier: | $2.0 \times 10^{13}$ ohm · cm |
| Volume resistance value of development sleeve: | $2.2 \times 10^{-1}$ ohm · cm |
| Fog prevention voltage: | 150 V |
| Contrast voltage: | 200 V |
| S value: | 2.6 |

When images were formed under the above conditions, fog was not generated; in other words, according to the aforementioned criteria regarding fog, the evaluation was level A. However, the image density of the solid black portion was 1.3, and the edge of the trailing portion of the solid black portion was accentuated. Further, toner was missing from the portion of the halftone area surrounding a solid black patch, accentuating the edge of the solid black patch.

(Embodiment 2)

Images were formed under the following conditions, with other structural conditions left the same as those for the first embodiment, and the fog and image density of the image on the transfer medium were evaluated.

<Conditions>

| | |
|---|---|
| Surface resistance value of photoconductive drum: | $1.6 \times 10^{10}$ ohm · cm |
| Volume resistance value of magnetic carrier: | $2.0 \times 10^{7}$ ohm · cm |
| Volume resistance value of development sleeve: | $2.2 \times 10^{-1}$ ohm · cm |
| Fog prevention voltage: | 150 V |
| Contrast voltage: | 200 V |
| S value: | 2.1 |

When images were formed under the above conditions, fog density was 0.7; fog was scarcely visible. According to the aforementioned criteria regarding fog, the evaluation was level B. However, on the photoconductive drum, fog density was 1.9, which is not problematic as far as the image on the recording medium is concerned, but, is slightly problematic in terms of durability, from the standpoint of the load placed on the cleaner. The image density of the solid black portion was no less than 1.4, and the highlight portion was free of roughness. In other words, satisfactory images were obtained.

(Embodiment 3)

This embodiment is different from the first embodiment only in the development bias waveform. Otherwise, it is the same as the first embodiment. Here, the development bias used in this embodiment will be described. In this embodiment, the development bias is the sequential combination of AC and DC biases. More specifically, the process in which voltage for inducing such force that moves the two-component developer from the image bearing member (photoconductive drum) to the developer bearing member (development sleeve) is applied for a predetermined length of time, and the process in which voltage for inducing such force that moves the two-component developer in the reverse direction, that is, from the development sleeve to the photoconductive drum, is applied for a predetermined length of time, are alternately repeated a predetermined number of times. Then, after the voltage for inducing the force for moving the two-component developer from the development sleeve to the photoconductive drum is applied for the last time, DC voltage equal to the voltage between the image and background portions of the electrostatic latent image on the photoconductive drum is applied to the development sleeve for a predetermined length of time. The latent image on the photoconductive drum is developed by repeatedly applying this sequential combination of the AC and DC biases (which hereinafter may be referred to as blank-pulse-bias) to the development sleeve.

With the application of the above described development bias, the AC bias which vibrates the toner particles in the adjacencies of the photoconductive drum, is applied after the DC bias (which hereinafter may be referred to as blank bias) which causes the toner particles to jump to only the image areas is applied. Therefore, there is generated such an effect that the T/D ratio of the developer has increased in the image areas. As a result, a sufficient amount of toner is uniformly supplied to the halftone areas. Therefore, smooth images, that is, images free of magnetic brush marks, can be obtained. On the other hand, on the background areas, the developer particles are not vibrated in the adjacencies of the photoconductive drum, and are gradually pulled back onto the development sleeve. Thus, when a photoconductive drum with a low resistance layer, the surface resistivity of which is in the range of $10^9$–$10^{14}$ ohm.cm as is in this embodiment, is employed, the amount by which electrical charge is injected into the photoconductive drum, in the development station, is very small. Therefore, images much better in terms of fog level are formed.

In this embodiment, a development bias in which a pulse which is 2 kV in peak-to-peak voltage Vpp, 12 kHz in frequency, and is rectangular in waveform, is kept on for a length of time equivalent to two pulses, and is kept off for a length of time equivalent to 6 pulses, is used. With the employment of this development bias in combination with the structural arrangement in the first embodiment, the fog prevention voltage, for example, can be reduced, which adds to the improvement of the reproduction of the dots in the low density areas of the latent image, as well as the improvement of tone reproduction.

As described above, according to the above described embodiments of the present invention, an image forming method in which an electrostatic latent image is formed on an image bearing member with a low resistance layer, the surface resistivity of which is in the range of $10^9$–$10^{14}$ ohm.cm, by exposing the image bearing member after charging it; and the latent image is developed in the development station, that is, the interface between the image bearing member and a developer bearing member containing a magnet, with the use of two-component developer containing toner and magnetic carrier, the volume resistivity of which is in the range of $10^6$–$10^{10}$ ohm.cm, and borne on the developer bearing member, by applying such development bias that is a combination of DC and AC voltages, was used in combination with a developer bearing member, the volume resistivity value of the surface of which is no less than $1\times10^{-1}$ ohm.cm and no more than $1\times10^2$ ohm.cm. As a result, high quality images, that is, images free of fog, were obtained for a long period of time.

Further, an image bearing member with a low resistance layer, the surface resistance of which in the range of $10^9$–$10^{14}$ ohm.cm, was employed. As a result, the image bearing member was efficiently charged using contact charging means of a charge injection type.

Further, as the developer for developing the electrostatic latent image formed on the image bearing member after the charging of the image bearing member, two-component developer, the resistance of which is high enough for the value of the electrical current, which flows the developer when the electric field strength is $2\times10^6$ V/m, to be no more than $23\times10^{-10}$ A, was used. As a result, the electrostatic latent images were developed without generating the latent image fog. Thus, high quality images were obtained.

While the invention has been described with reference to the structures disclosed herein, it is not confined to the details set forth and this application is intended to cover such modifications or changes as may come within the purposes of the improvements or the scope of the following claims

What is claimed is:

1. A developing apparatus comprising:

a developer container for containing a developer including toner and carrier particles;

a developer carrying member for carrying the developer contained in said developer container; and a voltage applying means for applying a developing bias voltage having a DC component and an AC component to said developer carrying member when an electrostatic image formed on an image bearing member including a surface layer having a volume resistivity in a range of $10^9$–$10^{14}$ Ωcm is developed by contacting the developer carried on said developer carrying member to develop the electrostatic image, wherein a volume resistivity of the carrier particles is in a range of $10^6$–$10^{10}$ Ωcm and a volume resistivity of said developer carrying member is in a range of $1\times10^{-1}$–$1\times10^2$ Ωcm.

2. An apparatus according to claim 1, wherein the volume resistivity of said developer carrying member is not less than $1\times10^1$ Ωcm.

3. An apparatus according to claim 1, wherein the bias voltage includes a first voltage for moving the toner from said developer carrying member toward said image bearing member, a second voltage for moving the toner from said image bearing member toward said developer carrying member, and a third voltage including only the DC component, the third voltage being applied subsequently to the first voltage, after the first and second voltages are applied a plurality of times.

4. An apparatus according to any one of claims 1 through 3, wherein a ratio S of a surface area of the entire toner relative to a surface area of the entire carrier is expressed in terms of an average particle size rt (μm) of the toner, a bulk density πt (g/cm$^3$) of the toner, an average particle size rc (μm) of the carrier, a bulk density πc (g/cm$^3$) of the carrier, and toner content n (weight %) and satisfies:

$$S=\{n/(100-n)\}\times(rc/rt)\times(\pi c/\pi t)\geqq 2.5.$$

5. An image forming apparatus comprising:

an image bearing member for bearing an electrostatic image, said image bearing member including a surface layer having a volume resistivity in a range of $10^9$–$10^{14}$ Ωcm;

a developer carrying member for carrying a developer including toner and carrier particles; and voltage applying means for applying a developing bias voltage having a DC component and an AC component to said developer carrying member when the electrostatic image formed on said image bearing member is developed by contacting the developer carried on said developer carrying member to develop the electrostatic image, wherein when an electric field of $2\times10^6$ V/m is formed, a current flowing through the developer between said image bearing member and said developer carrying member is not more than $2.3\times10^{-10}$, and wherein the carrier particles have a volume resistivity in a range of $10^6$–$10^{10}$ Ωcm.

6. An apparatus according to claim 5, wherein said developer carrying member has a volume resistivity in a range of $1\times10^{-1}$–$1\times10^2$ Ωcm.

* * * * *

UNITED STATES PATENT AND TRADEMARK OFFICE

CERTIFICATE OF CORRECTION

PATENT NO. : 6,925,269 B2
DATED : August 2, 2005
INVENTOR(S) : Masaru Hibino

It is certified that error appears in the above-identified patent and that said Letters Patent is hereby corrected as shown below:

Column 1,
Line 39, “They,” should read -- Then, --; and
Line 65, “described” should read -- described. --.

Column 2,
Line 38, “reliability” should read -- reliability. --; and
Line 45, “is” should read -- and is --.

Column 3,
Line 6, “pick” should read -- picked --.

Column 4,
Line 7, “these progresses,” should read -- this progress --;
Line 31, “a photoconductive,” should read -- a photoconductive drum, --;
Line 47, “is” should read -- have --; and
Line 49, “is” should read -- are --.

Column 5,
Line 53, “edges” should read -- edges. --.

Column 7,
Line 66, “mares” should read -- makes --.

Column 8,
Line 66, “an” should read -- and the --.

Column 12,
Line 32, “time” should read -- time. --.

Column 13,
Line 17, “is” should read -- are --.

Column 14,
Line 66, “tog” should read -- fog --.

UNITED STATES PATENT AND TRADEMARK OFFICE

CERTIFICATE OF CORRECTION

PATENT NO. : 6,925,269 B2
DATED : August 2, 2005
INVENTOR(S) : Masaru Hibino

It is certified that error appears in the above-identified patent and that said Letters Patent is hereby corrected as shown below:

Column 15,
Line 9, “measure” should read -- measured --.

Signed and Sealed this

Twenty-second Day of November, 2005

JON W. DUDAS
*Director of the United States Patent and Trademark Office*